United States Patent [19]

Helderle et al.

[11] Patent Number: 4,560,005

[45] Date of Patent: Dec. 24, 1985

[54] SLIDING-SLEEVE VALVE FOR AN OIL WELL

[75] Inventors: Paul M. Helderle, Boulogne; Fabrice R. Arnaud, Paris; Yannick Le Nours, Lorient, all of France

[73] Assignee: Compagnie Francaise des Petroles, Paris, France

[21] Appl. No.: 685,942

[22] Filed: Dec. 24, 1984

[30] Foreign Application Priority Data

Dec. 23, 1983 [FR] France ..... 83 20661

[51] Int. Cl.[4] ..... E21B 34/06; E21B 34/14

[52] U.S. Cl. ..... 166/332; 251/250; 166/373

[58] Field of Search ..... 166/332, 334, 330, 381, 166/386, 206, 209, 373; 251/250, 89, 58

[56] References Cited

U.S. PATENT DOCUMENTS

| | | | |
|---|---|---|---|
| 4,066,128 | 1/1978 | Davis et al. | 166/332 X |
| 4,427,175 | 1/1984 | Adams | 166/332 X |
| 4,429,747 | 2/1984 | Williamson | 166/386 X |

FOREIGN PATENT DOCUMENTS

| | | | |
|---|---|---|---|
| 491314 | 3/1954 | Italy | 251/250 |

*Primary Examiner*—Stephen J. Novosad
*Assistant Examiner*—David J. Bagnell
*Attorney, Agent, or Firm*—Sughrue, Mion, Zinn, Macpeak and Seas

[57] ABSTRACT

A sliding-sleeve valve for an oil well comprises a valve body provided with ports for the passage of fluid therethrough, and a longitudinally slidable sleeve for opening and closing the ports. The sleeve is located on the outside of the valve body and provided internally with drive teeth which are accessible from within the valve body through an orifice in the valve body. The sleeve is moved by an engagement and drive member carried by an actuating tool which is lowered into the valve body. The engagement and drive member is housed in a bush of the tool and caused to project through an orifice in the bush and into engagement with the drive teeth of the sleeve by ramp means during longitudinal displacement of an actuating rod of the tool.

9 Claims, 15 Drawing Figures

SLIDING-SLEEVE VALVE FOR AN OIL WELL

The invention relates to a sliding-sleeve valve intended to be used in an oil well and for connection between two elements of a production tube, in order to allow or prohibit the passage of a fluid between the space within the production tube and the annular space surrounding the production tube. Such valves are used in more or less large numbers in most oil-well completions, particularly to cause a fluid to circulate between the inner and annular spaces, in order to bring into production or isolate a productive zone of the well, so as to make the injection in a given underground formation.

Sliding-sleeve valves used at the present time comprise a tubular valve body provided with ports, a sleeve arranged within the body and which can slide longitudinally between a position masking the ports and a position exposing the ports, and means for actuating the sleeve to displace it from one of its positions to the other, the actuating means usually consisting of a tool displaced longitudinally by cable from the surface of the well ("wire-line").

It has been noted that there is a rapid deterioration in the operation of these valves: turbulence generated during the passage of the effluent comes in contact with valve gaskets, as a result of which they are damaged and lose their leak-proofing capacity as soon as they are displaced again; the movement of longitudinal translation of the sleeves of these valves risks causing the gaskets to be torn out; the sleeves are locked in the open or closed position by means of elastic metal fingers, these rapidly erode and the lock is no longer secure; the erosion of the sleeves may prevent them from being grasped by the actuating means, and the selection of the valve to be actuated becomes random.

Moreover, a tool other than the actuating means can accidentally open the sleeve of a valve during its passage through the valve. There is never any certainty of the exact position of the sleeve whether it is the opening position, the closing position or an intermediate position. When a valve opens under a high differential pressure, the actuating means can be ejected and obstruct the production tube partially or completely. The sleeves of these valves have to be thick because of the pressure to which they are subjected, thus necessitating considerable outside diameters of the valve bodies to ensure a sufficient inner passage cross-section. When the intention is to place a plug with its lock in a recess having an anchoring profile and made in the upper part of the valve, the operation must be carried out with great care to avoid the risk of anchoring in the recess left free for the displacement of the sleeve.

According to the invention there is provided a sliding-sleeve valve for an oil well comprising a valve body for connection to two production-tube elements for the oil well and provided with ports for the passage of a fluid, a sleeve slidable longitudinally along said body between a closing position closing said ports and an opening position exposing said ports, and an actuating tool adapted to be activated from the surface of the well for displacing said sleeve from one of said positions to the other of said positions, wherein said sleeve is arranged on the outside of said body and is provided on its radially inner surface with drive teeth, said body is provided with an access orifice providing access to said teeth, and said actuating tool comprises a bush provided with an outlet orifice and which is insertable and orientatable in said body so as to align said outlet orifice with said access orifice, and an actuating rod displaceable longitudinally in said bush and for causing by means of ramp means an engagement and drive member, for engaging said teeth and driving said sleeve longitudinally, to project laterally through said outlet orifice and said access orifice.

The actuating rod is preferably integral in terms of longitudinal displacement with the ramp means which is slidable longitudinally in the bush and which is associated with a driving rack, the teeth on the sleeve forming a receiving rack. The bush may be provided in alignment with the outlet orifice, a gear-wheel system which is retractable within the bush and which can be projected through the outlet orifice by movement of the system along the ramp means into engagement with the driving rack and the receiving rack.

The gear-wheel system is advantageously removably mounted on a pivot pin carried by the bush, and may comprise a single gear wheel which itself engages with the driving and receiving racks, so as to displace the sleeve in one direction, or two gear wheels engaging one another either directly or not, and of which one driving wheel engages the driving rack and the other receiving wheel engages the receiving rack, so as to displace the sleeve in the other direction, the two systems being interchangeable.

Inclined notches may be provided at the two longitudinal ends of the sleeve and an inclined finger may be arranged on the valve body at each of the two extreme locations of the sleeve during its longitudinal displacements. One of the fingers penetrates into one of the notches at each end of the longitudinal displacement of the sleeve and causes a slight rotation of the sleeve at the start of its next longitudinal displacement, to eliminate the risk that the gaskets of the sleeve will be torn out. This arrangement also makes it possible, in the opening position of the sleeve, to ensure that the ports of the valve body and the ports of the sleeve are superimposed perfectly.

The actuating tool may be guided and locked in the valve body by means of one of various known guidance and locking processes. Preferably the bush is provided with a lock biassed radially outwards so as to project through an aperture in the lateral wall of the bush and having a profile which, in the event that it encounters an obstacle, allows it to be retracted during a downward displacement and to be retained during an upward displacement. In an upper portion of the valve body, a cylindrical casing is provided having its lower edge in a plane inclined to a plane perpendicular to the axis of the casing and split along the shortest generating line to thus form a slot of a sufficient width to allow the passage of the lock, the shortest generating line being aligned with an anchoring groove in the valve body for receiving the lock.

The sleeve may advantageously be retained in its opening or closing position by means of two rings of the scraper ring type, one for locking the sleeve in the opening position and the other for locking the sleeve in the closing position. The rings are carried by the sleeve and a transverse locking slot is formed in the valve body in line with the access orifice at a location such that it receives one or other of the rings in dependence on the position of the sleeve.

The sleeve, which may comprise a first cylindrical part with a continuous wall followed by a second cylindrical part with a wall perforated with ports, is preferably provided, in addition to two gaskets located one towards one end of the first part and the other located towards the other end of the first part, an additional protective gasket located towards that end of the second part remote from the first part.

A position indicator for the gear-wheel system may be provided on the actuating tool, to make it possible, by means of simple inspection of the actuating tool when raised to the surface, to ascertain reliably the position of the sleeve.

An embodiment according to the invention will now be described, by way of example only, with reference to the accompanying drawings.

Figure 6:
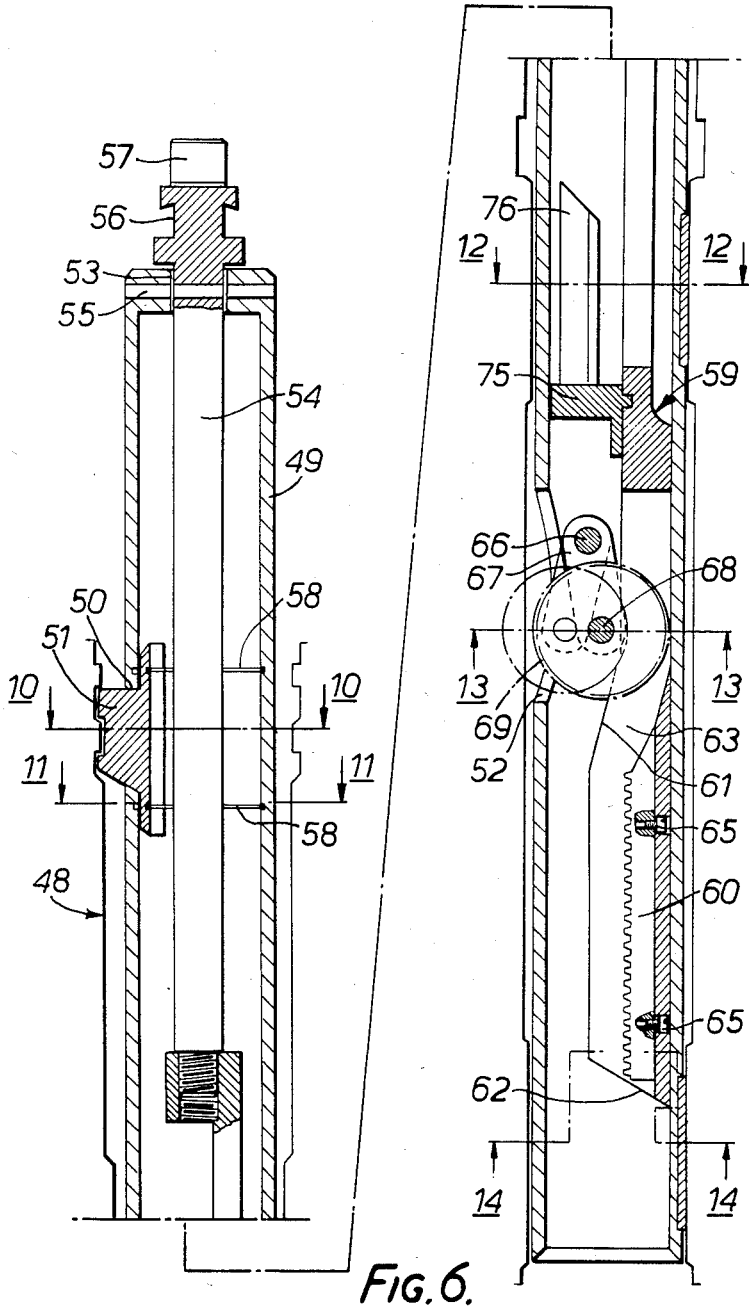
FIG. 6 is a longitudinal section through an embodiment of an actuating tool for the valve.
Figure 9:
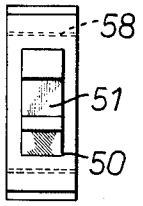
Figure 10:
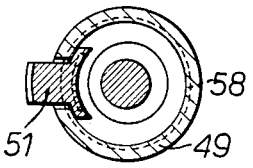
Figure 11:
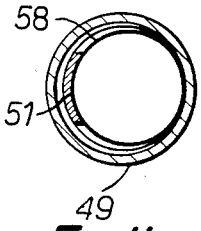
Figure 12:
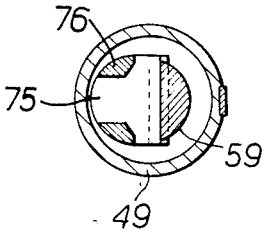
Figure 13:
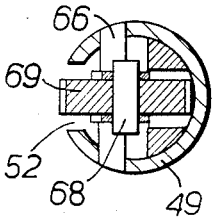
Figure 14:
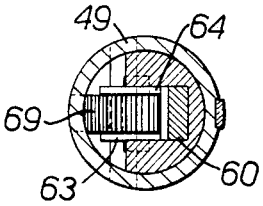
Figure 15:
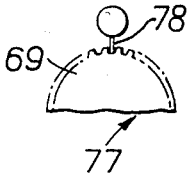

FIGS. 9, 10 and 11 are respectively a side view of the anchoring portion of the tool, a section through the tool along the line 10—10 of FIG. 6 and a section through the tool along the line 11—11 of FIG. 6;

FIGS. 12, 13 and 14 are sections through the actuating tool along the lines 12—12, 13—13 and 14—14 of FIG. 6; and FIG. 15 shows diagrammatically a position-indicating device for the valve.

Figure 1:
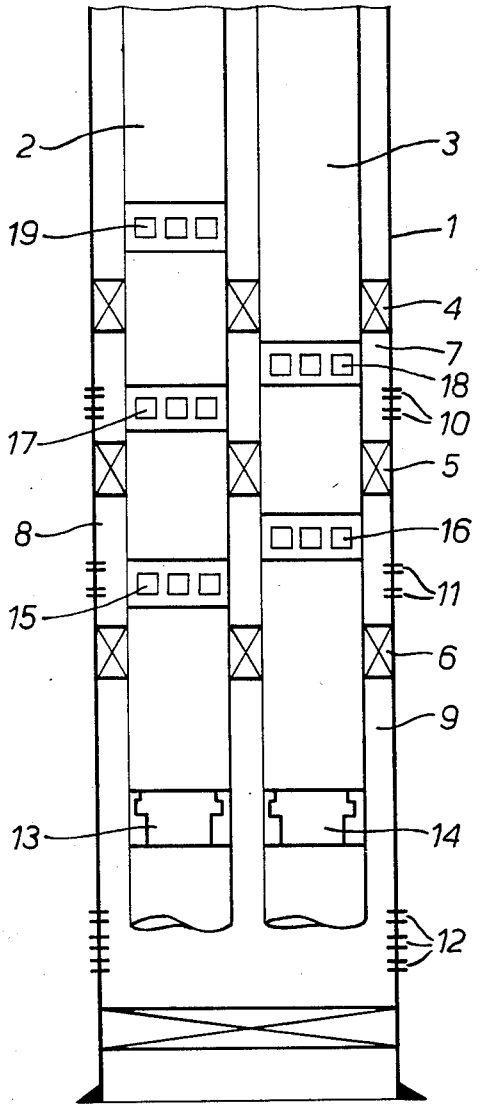
FIG. 1 shows diagrammatically the installation of sliding-sleeve valves in an oil well.

FIG. 1 illustrates a portion of an oil well provided with casing or tubing 1 and two production tubes 2 and 3. Between the production tubes 2 and 3 and the tubing 1, sealing liners (packers) 4, 5, 6 define production zones 7, 8, 9 corresponding to respective perforations 10, 11, 12 in the tubing 1. In the deepest production zone 9, the production tubes 2 and 3 each possess a seat 13, 14 making it possible to isolate this zone or bring it into production. In the production zone 8, the production tubes 2 and 3 are each provided with a sliding-sleeve production valve 15, 16. In the production zone 7, the production tubes 2 and 3 are each provided with a sliding-sleeve production valve 17, 18. Above the packer 4, the production tube 2 is provided with a sliding-sleeve circulation valve 19 which makes it possible to ensure fluid circulation between the space outside the production tubes 2 and 3 and the space within the production tube 2. All the valves 15, 16, 17, 18 and 19 are advantageously of a type with an outer sliding sleeve, an embodiment of which will be described.

Figure 2:
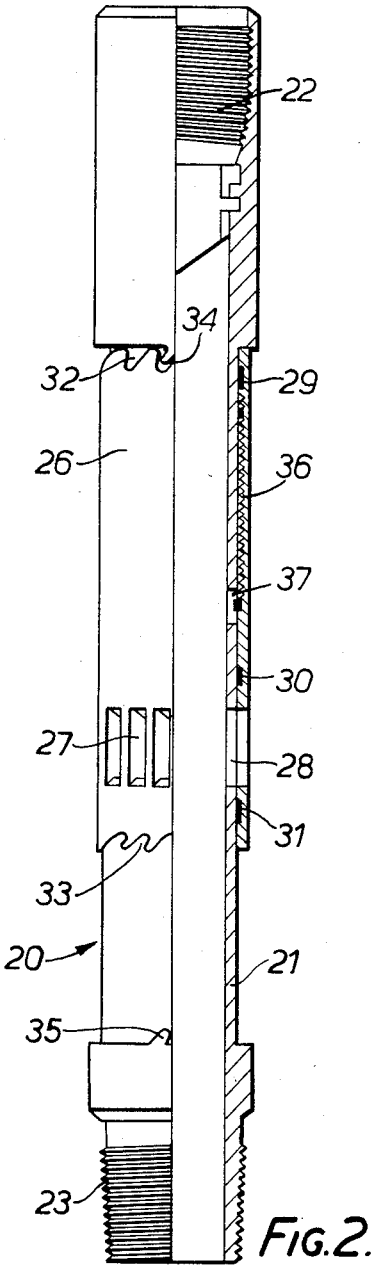
FIGS. 2 and 3 are a half-elevation and a longitudinal half-section through an embodiment of a sliding-sleeve valve according to the invention in the opening position and closing position respectively.
Figure 3:
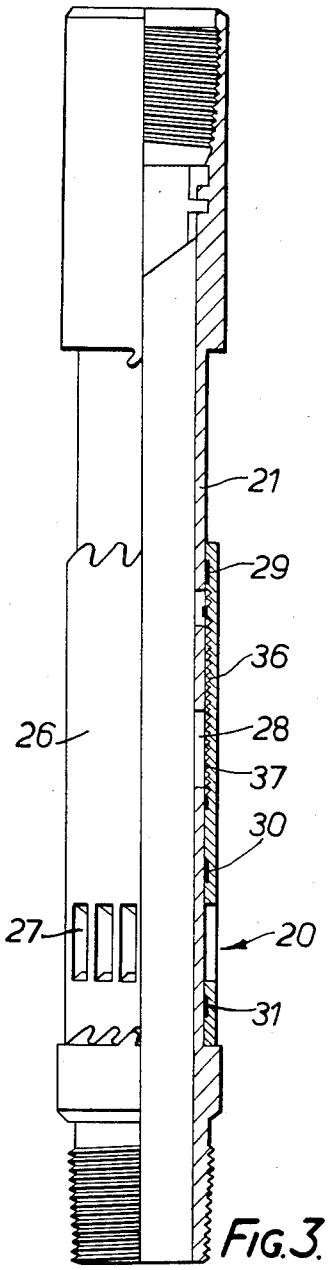
Figure 4:
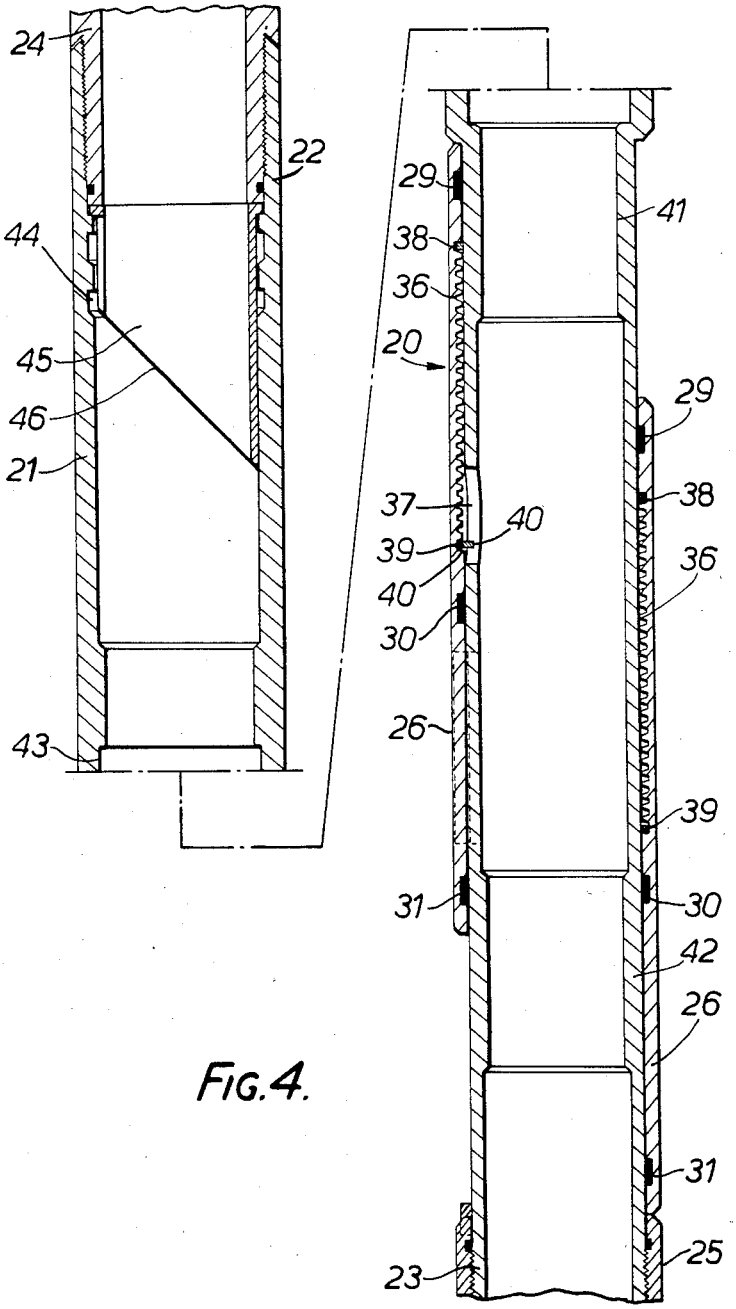
FIG. 4 is, on a larger scale, a longitudinal section through the sliding-sleeve valve of FIGS. 2 and 3 in the opening position on the left and in the closing position on the right.

In FIGS. 2 and 3, a valve 20, such as one of the valves 15, 16, 17, 18, 19, is shown which comprises a body 21 provided at its longitudinal ends with threaded connection portions, being a female portion 22 and a male portion 23 respectively, for connection to production-tube elements, such as elements 24 and 25 shown in FIG. 4. An outer sliding sleeve 26 comprises a continuous upper part and a lower part with passage ports 27 which, in the opening position of the valve 20 (FIG. 2), are superimposed or aligned with corresponding passage ports 28 in the valve body 21. The sleeve 26 is provided on its radially inner face with two moulded annular gaskets 29 and 30 which bear against the radially outer face of the valve body 21 and which, in the closing position of the valve (FIG. 3), frame the ports 28 in the valve body, so that these are then closed by a continuous-wall part of the sleeve 26. An additional moulded annular gasket 31 is located below the ports 27 for protection purposes.

The sleeve 26 carries at its longitudinal ends upper notches 32 and lower notches 33 which are inclined in opposite directions, whilst the valve body 21 carries an upper inclined finger 34 and a lower inclined finger 35. The finger 34 is intended to engage in one of the notches 32 in the opening position of the valve, to ensure that the ports 27 and 28 are superimposed, and the finger 35 is intended to engage in one of the notches 33 during closing of the valve 20. When the sleeve 26 leaves one of its two positions (upper opening position and lower closing position) by being displaced longitudinally, it must execute a slight rotation because of the inclination of the fingers and notches.

For the purpose of displacement of the sleeve 25, the inner surface of the sleeve is provided with teeth in the form of a circular receiving rack 36 (FIG. 4), and an access orifice 37 is provided in the valve body 21 so that the rack 36 can be engaged from within the valve body 21, as will be seen below. The rack 36 is bordered at its two longitudinal ends by a scraper ring 38 for locking the sleeve 26 in its closing position and by a scraper ring 39 for locking the sleeve 26 in its opening position. Each of these rings 38, 39 is intended to engage in a transverse slot 40 milled in the valve body 21 and shown in FIGS. 4 and 5. The slot 40 intersects the access orifice 37, to make it possible to release the scraper ring engaged in the slot 40 before each actuation, as will be explained below.

Figure 5:
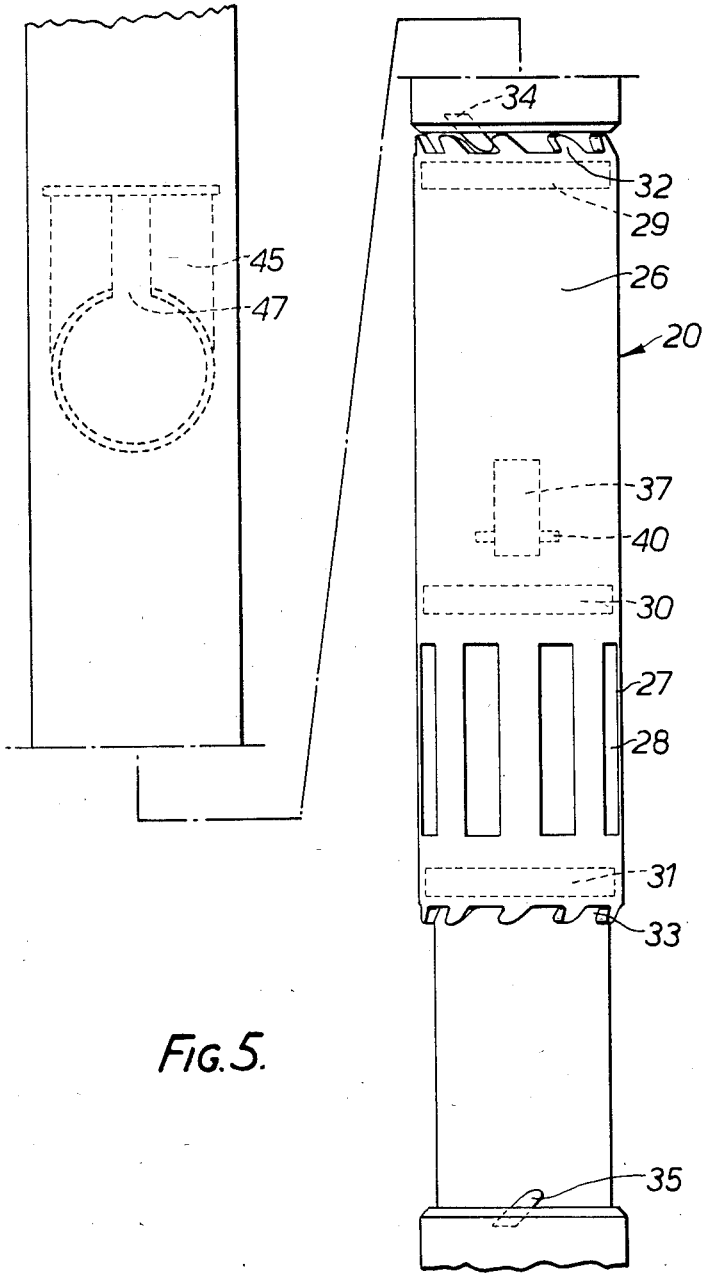
FIG. 5 is an outside view in elevation of the valve in the opening position.

As can be seen in FIG. 4, the valve body 21 is provided on the inside, in a conventional way, with an upper machined part 41 and a lower machined part 42 for equipment, such as plugs or an insulating sleeve, actuated by cable, and a groove 43 for locking such equipment. In its upper part, the valve body 21 is provided with an anchoring groove 44 and carries a cylindrical casing 45 which, as shown in FIG. 4, has a lower edge 46 extending in a plane inclined to a plane perpendicular to the axis of the valve body and, as shown in FIG. 5, is provided with a slot 47 extending along the shortest generating line of the casing 45 and aligned with the circumferential position which desirably is assumed to be by a lock mounted on the actuating tool of the valve, as will be seen from the description of the tool.

An actuating tool 48 for the valve is shown in FIG. 6. The tool is lowered in the valve body 21, when it is required to displace the sliding sleeve 26, and it is raised to the surface after the displacement has been carried out.

The actuating tool comprises a bush 49 provided laterally, in its upper part, with an aperture 50 for the passage of a lock 51 and, in its lower part, with an outlet orifice 52 for the passage of a member for engaging and driving the receiving rack 36 of the sliding sleeve 26.

The bush 49 has at its upper end a passage 53 for an actuating rod 54 which is retained by a shearing pin 55 during the descent of the actuating tool 48 within the production tube and the valve body 21. A grasping head 56 is screwed to the top of the actuating rod 54 and retained by means of a nut 57.

The lock 51 is biassed into a radially outer position, in which it projects through the aperture 50, by means of elastic rings 58, as shown in FIGS. 6, 9, 10 and 11. The lock 51 has an inclined lower profile, so that the lock is moved inwardly of the bush in the event it encounters an obstacle during downward movement, and an upper profile extending perpendicular to the longitudinal axis of the bush 49.

The actuating rod 54 is connected at its lower end to a movable assembly 59 comprising, in a position which initially is below the orifice 52, a driving rack 60, the teeth of which are arranged in succession along a longitudinal line. A ramp 61 for guiding a gear wheel onto the rack and a ramp 62 for guiding the gear wheel off the rack are connected by means of cheeks 63 and 64 which border the rack 60 laterally, as can be seen better in FIGS. 8 and 14.

The rack 60 is retained on the movable assembly 59 by means of assembly and safety screws 65 which, in the event of an abnormal passage over the rack 60, make it possible nevertheless to remove the actuating tool, at the same time relinquishing the rack 60.

Figure 8:
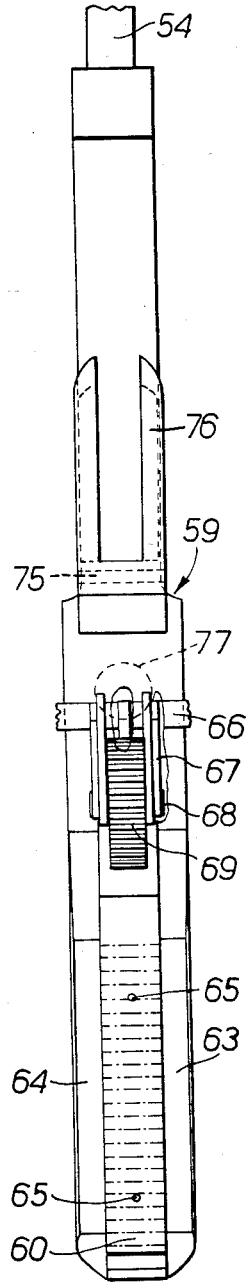
FIG. 8 is a partial inside view of the tool of FIG. 6.

The bush 49 carries within it, in the region of the orifice 52, a fixed pin 66, on which is mounted a pivotable arm 67 carrying a movable pin 68, about which a gear wheel 69 is rotatable, as can be seen in FIGS. 6, 8, and 13. A restoring spring (not shown) biasses the pivotable arm 67 away from the orifice 52. When the actuating tool is in place in the valve body 21 and the movable assembly 59 is pulled upwardly, the arm 67 is moved outwardly by the ramp 61 and the gear wheel 69 engages simultaneously the rack 60 and the receiving rack 36. At the same time, the gear wheel 69 releases the scraper ring 39 from the slot 40.

Figure 7:
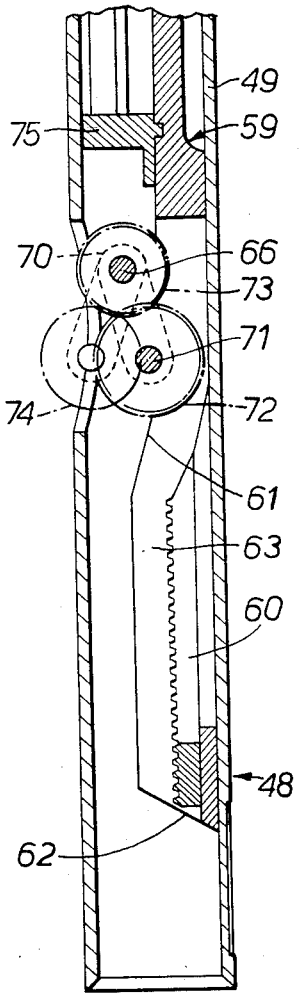
FIG. 7 shows a portion of the tool modified so that it can execute a reverse displacement of the sleeve of the valve.

FIG. 7 illustrates the way in which the actuating tool 48 is modified for displacement of the sleeve 26 in the opposite direction. For this purpose, the arm 67 is replaced by a pivotable arm 70 carrying a movable pin 71 on which a receiving gear wheel 72 is rotatable, a driving gear wheel 73 constantly engaging the gear wheel 72 is mounted on the pin 66. The gear wheel 72 has a diameter less than that of the gear wheel 69, so that, when the arm 70 is moved by the ramp 61 to bring wheel 72 into engagement with receiving rack 36, the rack 60 does not come in contact with the gear wheel 72, but engages with the gear wheel 73. The rack 60 is then connected to the receiving rack 36 by means of the kinematic chain consisting of the gear wheel 73 and the gear wheel 72, the latter being in the position 74 and rotating in the opposite direction to the gear wheel 73. In this case, it is the gear wheel 72 which releases the scraper ring 38 from the slot 40.

The movable assembly 59 also carries, in a position above the orifice 52, a support 75 for an unlocking fork 76 which is directed upwards and the function of which, when the actuating rod 54 is raised sufficiently, is to engage the lock 51 and move it radially inwardly against the bias of the elastic rings 58. The fork 76 can be seen in FIGS. 6 and 12.

In FIG. 8, a line 77 surrounds a detail illustrated diagrammatically on a larger scale in FIG. 15 in a side view. A fixed pawl 78 carried by the bush 49 engages in the teeth of the gear wheel 69, so that, by means of a reference mark on the gear wheel 69, it is possible, after the tool 48 has been actuated and raised to the surface, to ascertain the rotation of the gear wheel 69 and consequently the displacement of the receiving rack 36, thus giving a reliable indication of the position of the valve 20.

The valve 20 is operated as follows. The actuating tool 48 is lowered in the production tube and the valve body 21, the lock 51 being retracted during this descent, until the lock 51 is located underneath the casing 45. The actuating tool 48 is then raised, so that the lock 51 slides on the inclined lower edge 46 of the casing 45, until it is inserted in the slit 47 and then engages in the anchoring groove 44. In the course of the upward movement the pin 55 is sheared and the actuating rod 54 can then be raised, while the bush 49 remains secured in the valve body 21 by means of the lock 51. The driving rack 60 rises and engages with the gear wheel 69 which has been moved outwardly by the ramp 61 and engages with the receiving rack 36. As the actuating rod 54 continues to be raised, the receiving rack 36 and consequently the sleeve 26 are displaced downwards, until the gear wheel 69 resumes its retracted position within the bush 49 by means of the ramp 62. To raise the actuating tool 48 to the surface, the actuating rod 54 continues to be raised and the fork 76 releases the lock 51 from the anchoring groove 44, after which the actuating tool can be brought to the surface, where it can be examined to ensure that the wheel 69 has actually rotated through the desired angle to execute the complete displacement of the sleeve 26.

If the reverse displacement of the sleeve 26 is to be executed, the procedure is the same, but the gear wheel 69 is replaced by the set of two gear wheels 72 and 73.

The means for driving the sliding sleeve 26 from the actuating rod 54 may differ from that described above. For example, if longer orifices 52 and 37 are provided, the actuating rod 54 may drive the receiving rack 36, or teeth carried by the sliding sleeve 26, directly in longitudinal displacement by engagement means intended for engaging the sleeve and projected through the orifice 52 by means of a ramp provided in the bush 49. The displacement of the sliding sleeve 26 in the opposite direction may then be obtained by the insertion of a fixed toothed pinion between two toothed slides, one of which would be made integral with the actuating rod and the other made integral with a means of engagement with the sliding sleeve 26.

Many other alternatives or modifications can be made to the embodiment described above by the provision of various methods of relative displacement between a ramp and engagement means designed to engage the sleeve and actuated by the actuating rod, so that these engagement means can project through an outlet orifice in the bush of the actuating tool and engage with the sleeve.

There is thus provided a sliding-sleeve valve in which the disadvantages set out above of known sliding-sleeve valves are mitigated and particularly in relation to the protection of the sleeve from erosion, risks of actuating errors and high pressure stresses.

FIG. 1 illustrates a double oil-well completion, to make it possible to understand more clearly the additional usefulness which there is in the reduction in bulk achieved by means of valves as described above with an outer sliding sleeve, but it is evident that such valves can also be used in a single completion with a single production tube.

What is claimed is:

1. A sliding-sleeve valve (20) for an oil well, comprising: a valve body (21) for connection to two production-tube elements (24, 25) of the oil well, port means (28) in said valve body for the passage of a fluid, a sleeve (26) arranged on the outside of said valve body and slidable longitudinally therealong between a closing position closing said port means and an opening position exposing said port means, a receiving rack (36) having drive teeth provided on a radially inner surface of said sleeve, an access orifice (37) in said valve body providing access to said teeth, and an actuating tool (48) adapted to be activated from the surface of the well for displacing said sleeve from one of said positions to the other, said actuating tool comprising a bush (49) provided with an outlet orifice (52) and which is insertable and orientable in said valve body so as to align said outlet orifice with said access orifice, an engagement and drive member (69) for engaging said teeth and driving said sleeve longitudinally, ramp means (61) and an actuating rod (54) displaceable longitudinally in said bush for causing by means of said ramp means said engagement and drive member to project laterally through said outlet and access orifices into engagement with said teeth.

2. A valve according to claim 1, wherein said actuating rod is longitudinally displaceable with said ramp means which is slidable longitudinally in said bush, a driving rack (60) is associated with said ramp means and a gear wheel system is carried by said bush aligned with said outlet orifice, said gear-wheel system being retractable within said bush and adapted to be projected through said outlet orifice by movement of said gear-wheel system along said ramp means, said gear-wheel system in its projected condition being engageable with said driving rack and with said receiving rack.

3. A valve according to claim 2, wherein said gear-wheel system comprises a pivot pin carried by said bush, an arm pivotally mounted on said pivot pin, and a receiving gear wheel mounted on said arm, said arm being arranged to be displaced by said ramp means to cause said receiving gear wheel to engage said receiving rack, said receiving gear wheel being then linked kinematically to said driving rack.

4. A valve according to claim 3, comprising two interchangeable gear-wheel systems for mounting on said pivot pin, one system comprising said receiving gear wheel which has sufficient diameter to be capable of engaging simultaneously said driving rack and said receiving rack, and the other system comprising a driving gear wheel engaging said receiving gear wheel and mounted on the said pivot pin for engagement with said driving rack, when said receiving gear wheel engages said receiving rack.

5. A valve according to claim 2, comprising a position indicator for indicating the angular position of said gear-wheel system.

6. A valve according to claim 1, wherein said sleeve is provided with inclined notches at its two longitudinal ends, and said valve body carries an inclined finger at each of the two extreme locations of said sleeve during its longitudinal displacements, one of said fingers penetrating into one of said notches at the end of a longitudinal displacement of said sleeve and causing a slight rotation of said sleeve at the start of its next longitudinal displacement.

7. A valve according to claim 1, comprising a lock provided on said bush of said actuating tool, said lock being biassed radially outwards so as to project through an aperture in the lateral wall of said bush, and having a profile which, in the event that it encounters an obstacle, causes it to be retracted during a downward displacement and to be retained during an upward displacement, and said valve body is provided at its upper end with a cylindrical casing having a lower end extending in a plane inclined to a plane perpendicular to the axis of said casing and provided with a slot along the shortest generating line thereof for receiving said lock, said slot being aligned with an anchoring groove in said valve body for receiving said lock.

8. A valve according to claim 1, comprising two rings provided on said sleeve, said rings being the scraper ring type, one for locking said sleeve in said opening position and the other for locking said sleeve in said closing position, wherein a transverse locking slot is provided in said valve body in the region of said access orifice for receiving one or other of said rings in dependence on the position of said sleeve.

9. A valve according to claim 1, wherein said sleeve comprises a first cylindrical part with a continuous wall followed by a second part with a wall provided with ports and three gaskets are provided, a first located towards one end of said first part, a second located towards the other end of said first part, and the third located towards that end of said second part remote from said first part.

* * * * *